US010053630B2

(12) United States Patent
Siskin et al.

(10) Patent No.: US 10,053,630 B2
(45) Date of Patent: Aug. 21, 2018

(54) CONTROL OF COKE MORPHOLOGY IN DELAYED COKING

(71) Applicants: Michael Siskin, Westfield, NJ (US); Ramesh Varadaraj, Bartlesville, OK (US)

(72) Inventors: Michael Siskin, Westfield, NJ (US); Ramesh Varadaraj, Bartlesville, OK (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 428 days.

(21) Appl. No.: 14/698,398

(22) Filed: Apr. 28, 2015

(65) Prior Publication Data

US 2015/0329784 A1 Nov. 19, 2015

Related U.S. Application Data

(60) Provisional application No. 61/993,090, filed on May 14, 2014.

(51) Int. Cl.
*C10B 57/04* (2006.01)
*C10B 57/06* (2006.01)
(Continued)

(52) U.S. Cl.
CPC ..... *C10B 57/04* (2013.01); *C10B 53/00* (2013.01); *C10B 55/00* (2013.01); *C10B 57/045* (2013.01);
(Continued)

(58) Field of Classification Search
CPC ..... C10B 57/06
See application file for complete search history.

(56) References Cited

U.S. PATENT DOCUMENTS 4,534,854 A 8/1985 Weinberg et al.
5,009,767 A * 4/1991 Bartilucci ..... C10B 55/00 201/20
(Continued)

FOREIGN PATENT DOCUMENTS

WO 03048271 A1 6/2003
WO 2004104139 A1 12/2004
(Continued)

OTHER PUBLICATIONS

PCT Application No. PCT/US2015/028231, Communication from the International Searching Authority, International Search Report and Written Opinion, Forms PCT/ISA/220, PCT/ISA/210 and PCT/ISA/237, dated Jul. 8, 2015, 11 pages.
(Continued)

*Primary Examiner* — Bobby Ramdhanie
*Assistant Examiner* — Briana M Obenhuber
(74) *Attorney, Agent, or Firm* — Glenn T. Barrett

(57) ABSTRACT

A delayed coking process in which shot coke and thermally cracked coker products are produced from a sponge coke-and/or transition coke-forming resid feed comprising sponge coke asphaltenes by mixing heteroatom (preferably nitrogen) containing asphaltenes from a shot coke-forming resid with a heated sponge coke-forming resid to form shot coke directing asphaltene aggregates in the resid. The mixture of resid with the added asphaltene is held at an elevated temperature to allow co-aggregates of sponge coke and shot coke asphaltenes to form which, upon delayed coking promote the production of a free-flowing shot coke product.

17 Claims, 2 Drawing Sheets

(51) Int. Cl.

| | |
|---|---|
| ***C10B 53/00*** | (2006.01) |
| ***C10B 55/00*** | (2006.01) |
| ***C10G 55/04*** | (2006.01) |
| ***C10G 9/00*** | (2006.01) |

(52) U.S. Cl.
CPC ..... *C10B 57/06* (2013.01); *C10G 9/005* (2013.01); *C10G 55/04* (2013.01); *C10G 2300/202* (2013.01); *C10G 2300/205* (2013.01); *C10G 2300/206* (2013.01)

(56) References Cited

U.S. PATENT DOCUMENTS

| | | | | |
|---|---|---|---|---|
| 7,374,665 | B2 | 5/2008 | Eppig et al. | |
| 7,871,510 | B2 | 1/2011 | Leta et al. | |
| 7,914,668 | B2 | 3/2011 | Siskin et al. | |
| 2005/0269247 | A1 | 12/2005 | Sparks et al. | |
| 2005/0284798 | A1* | 12/2005 | Eppig ..... | C10B 55/00 208/131 |
| 2009/0314689 | A1* | 12/2009 | Varadaraj ..... | C10B 55/00 208/48 AA |

FOREIGN PATENT DOCUMENTS

| | | | |
|---|---|---|---|
| WO | 2005113708 | A1 | 12/2005 |
| WO | 2005113709 | A1 | 12/2005 |
| WO | 2005113710 | A1 | 12/2005 |
| WO | 2005113711 | A1 | 12/2005 |
| WO | 2005113712 | A1 | 12/2005 |
| WO | 2007050350 | A1 | 5/2007 |
| WO | 2007058750 | A1 | 5/2007 |

OTHER PUBLICATIONS

P.J. Ellis and C.A. Paul, "Tutorial: Delayed Coking Fundamentals", AIChE 1998 Spring National Meeting, New Orleans, Louisiana, Mar. 1998, Paper 29a.

M. Siskin, S.R. Kelemen, C.P. Eppig, L.D. Brown and M. Afeworki, "Asphaltene Molecular Structure and Chemical Influences on the Morphology of Coke Produced in Delayed Coking", Energy & Fuels, 2006, 20, pp. 1227-1234.

M. Siskin, S.R. Kelemen, M.L. Gorbaty, D.T. Ferrughelli, L.D. Brown, C.P. Eppig and R.J. Kennedy, "Chemical Approach to Control Morphology of Coke Produced in Delayed Coking", Energy & Fuels, 2006, 20, p. 2117-2124.

S.R. Kelemen, M. Siskin, M.L. Gorbaty, D.T. Ferrughelli, P.J. Kwiatek, L.D. Brown, C.P. Eppig and R.J. Kennedy, "Delayed Coker Coke Morphology Fundamentals: Mechanistic Implications Based on XPS Analysis of the Composition of Vanadium- and Nickel-Containing Additives During Coke Formation", Energy & Fuels, 2007, 21, p. 927-940.

* cited by examiner

CONTROL OF COKE MORPHOLOGY IN DELAYED COKING

CROSS-REFERENCE TO RELATED APPLICATIONS

The present application claims priority to U.S. Patent Application Ser. No. 61/993,090, filed May 14, 2014, which is incorporated herein in its entirety.

FIELD OF THE INVENTION

The present invention relates to a delayed coking process and more particularly to a delayed coking process for controlling the morphology of the coke product.

BACKGROUND OF THE INVENTION

Delayed coking is one of several types of process used in oil refineries to convert heavy oils to useful lighter products. Essentially, it is a carbon rejection process in which the hydrogen:carbon ratio of the heavy oil feed is increased to form lower boiling products with a higher hydrogen content by eliminating the excess carbon in the form of the coke product. In delayed cokers, the heavy oil feed is preheated in the same fractionation tower (the coker combination tower) used to separate the cracking products into differently boiling fractions. This pre-heated feed, together with any recycled bottoms from the combination tower, is then fed into a continuously operating process furnace to effect a limited extent of thermal cracking, after which it enters a large, vertically-oriented cylindrical vessel or coking drum, in which the major portion of coking reactions take place. Usually, two or more drums are fed by a single furnace so that the drums can be filled and emptied in sequence while running the furnace continuously, making this a semi-batch process. In the coke drum, large oil molecules are further thermally cracked to form additional lighter products and residual coke, which fills the vessel. The lighter hydrocarbons flow out of an outlet at the top of the drum as vapor and are further processed into fuel products after passing through a coker combination tower from which a bottoms stream may be withdrawn for recycle with the fresh feed. Gradually the coke accumulates in the drum until it is almost filled with coke. When the drum is nearly filled, the hot oil from the furnace is directed to a clean coke drum, while the full one is decoked. The decoking cycle involves cooling, depressuring and draining water from the drum, purging it with steam to remove residual hydrocarbon vapor, opening up the top and bottom heads (closures) on the drum and then using high pressure water lances or mechanical cutters to remove the coke from the drum. The coke falls out the bottom of the drum into a pit, where additional water is drained off and conveyers take the coke to storage or rail cars. The drum is then closed up and is ready for another coking cycle.

The feedstocks for delayed cokers are typically the heaviest (highest boiling) fractions of crude oil that are separated in the crude fractionation unit, normally comprising an atmospheric distillation tower and vacuum tower. The nature of the coke formed is highly dependent on the characteristics of the feedstock to the coker as well as upon the operating conditions used in the coker. Although the resulting coke is generally thought of as a relatively low value by-product, it may have some value, depending on its grade, as a fuel (fuel grade coke) or for electrodes for aluminum or steel manufacture (anode grade coke). Generally, the delayed coker is considered to produce three types of coke with different morphologies that have different appearances, properties and economic values. Needle coke, sponge coke, and shot coke are the most common along with transitional forms. Needle coke is the highest quality of the three varieties which commands a premium price; upon further thermal treatment, needle coke has high electrical conductivity (and a low coefficient of thermal expansion) and is used to make the electrodes in electric arc steel production. It is low in sulfur and metals and is frequently produced from some of the higher quality coker feedstocks that include more aromatic feedstocks such as slurry and decant oils from catalytic crackers and thermal cracking tars. Typically, it is not formed by coking of resid type feeds. Sponge coke, a lower quality coke, is most often formed in refineries from lower quality refinery coker feedstocks having significant amounts of asphaltenes, heteroatoms and metals. If the sulfur and metals content is low enough, sponge coke can be used for the manufacture of anodes for the aluminum industry. If the sulfur and metals content is too high for this purpose, the coke can be used as fuel. The name "sponge coke" comes from its porous, sponge-like appearance. Conventional delayed coking processes, using the vacuum resid feedstocks, will typically produce sponge coke, which is produced as an agglomerated mass that needs an extensive removal process including drilling and water-jet cutting technology.

Shot coke is considered the lowest quality coke. The term "shot coke" comes from its spherical or ovoidal shape bail-like shape, typically in the range of about 1 to about 10 mm diameter. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke. For example, coke that has a mostly sponge-like physical appearance, but with evidence of small shot spheres beginning to form as discrete shapes. The term "transition coke" can also refer to mixtures of shot coke bonded together with sponge coke.

In the semibatch delayed coking process, the drum is filled with the heated feed until the coke bed, typically at a temperature of 425° C. or higher has filled a drum; the coke mass must then stripped of cracking products with steam and then cooled and cut from the drum using high-pressure water jets. The coke cooling and cutting steps can take several hours per 12-15 hour cycle, and frequently the cooling is nonuniform, presenting hazards during the cutting operation. If 100% free-flowing (nonbonded) shot coke were produced, no cutting/drilling would be required and a significant reduction in cycle could be achieved along with a corresponding increase in unit throughput resulting in an increase in the production of liquid hydrocarbon products which are the economic drivers of the process. The production of shot coke can therefore be regarded as economically desirable regardless of the low value of the coke by-product.

Articles in the technical literature by Siskin and Kelemen together with their colleagues have provided insights into the possibilities of controlling coke morphology. See, for example. Siskin et al, "Asphaltene Molecular Structure and Chemical Influences on the Morphology of Coke Produced in Delayed Coking", *Energy & Fuels* 2006, 20, 1227-1234; Siskin et al, "Chemical Approach to Control Morphology of Coke Produced in Delayed Coking", *Energy & Fuels,* 2006, 20, 2117-2124; Kelemen et al, "Delayed Coker Coke Morphology Fundamentals: Mechanistic Implications Based on XPS Analysis of the Composition of Vanadium and Nickel-Containing Additives During Coke Formation," *Energy & Fuels* 2007, 21, 927-940. In addition, a series of patents and applications from ExxonMobil Research and Engineering Company presented different proposals for promoting the production of a free-flowing shot coke during the delayed coking process; publications of these include U.S. Pat. Nos. 7,374,665; 7,871,510; 03/048271; 2007/050350; 2004/104139; 2005/113711; 2005/113712; 2005/113710; 2005/113709; 2005/113709; 2005/113708; 2007/058750.

While previous work was successful in enabling the morphology of the delayed coke product to be controlled by reference to the metals (Ni, V, Na, K) content of the resid it did not define the limits bracketing the shot coke formation window in a wholly quantitative or mechanistic manner so as to provide a higher degree of certainty in the formation of a free-flowing shot coke. A fuller understanding of the interfacial surface effects required for more definitive control of the coke morphology will, however, provide the refiner with higher certainty for forming shot coke that allows more reliable operation and enhanced safety of operation for instance, by enabling throttling drum closure valves to be fitted on the coke discharge ports at the bottom of the coke drum as described in U.S. 2005/0269247. Continuous operation of the delayed coker may also become possible with adequate control of the coke morphology as described in U.S. Pat. No. 7,914,668.

SUMMARY OF THE INVENTION

We have now found that it is possible to alter the morphology of the coke produced in the delayed coking process to promote the formation of shot coke from residual feeds which would otherwise form sponge coke. The method we have devised achieves this result by promoting the aggregation of sponge coke asphaltenes in the resid at coking temperatures and pressures.

The aggregation of the sponge coke asphaltenes in resid is achieved by allowing the sponge coke asphaltenes to co-aggregate with pre-formed shot coke asphaltene aggregates. The result is a mass of swollen co-aggregates of sponge coke and shot coke asphaltenes which is stable at high temperatures and, when subject to delayed coking conditions, has a tendency to retain the co-aggregate morphology and form shot coke.

According to the present invention, therefore, we provide a delayed coking process in which shot coke and thermally cracked coker products are produced from a sponge coke- and/or transition coke-forming resid feed comprising sponge coke asphaltenes. The process comprises, in summary, the following steps: mixing asphaltene derived from a shot coke-forming petroleum residual feed with or into a heated sponge coke- and/or transition coke-forming petroleum residual feed to form shot coke directing asphaltene aggregates in the resid; holding the mixture of resid and the asphaltenes aggregates at an elevated temperature to allow co-aggregates of sponge coke and shot coke asphaltenes to form, and heating the heated resid containing the co-aggregates to a delayed coking temperature to form shot coke and thermally cracked coker products.

Further details of the method are described with a brief reference to the proposed mechanisms below.

DETAILED DESCRIPTION

Delayed Coking

Figure 1:
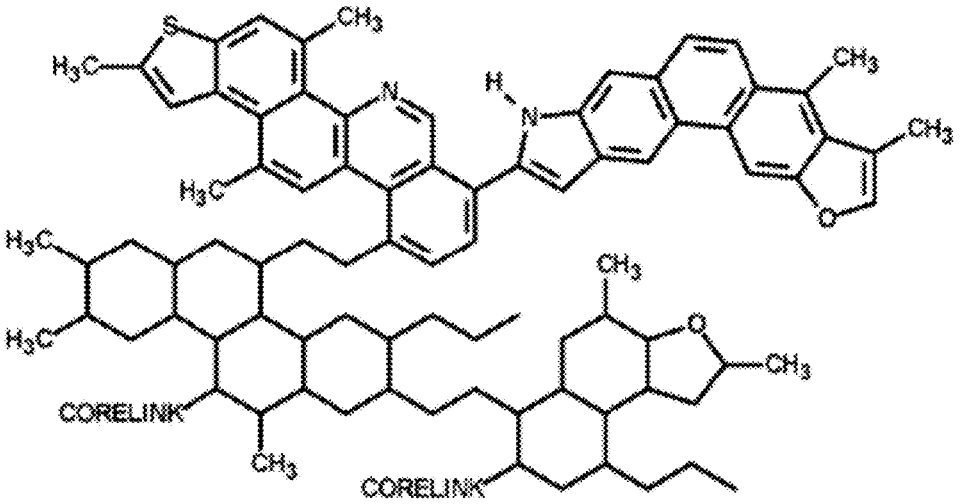
FIG. 1 is an exemplary representation of the structure of a shot coke forming asphaltene.

The delayed coking process and the coking units have been described by Ellis et al in "Tutorial: Delayed Coking Fundamentals", AIChE 1998 Spring National Meeting, New Orleans, La., March 1998, Paper 29a, ® 1998 Great Lakes Carbon Corporation, to which reference is made for such as description, Petroleum residua ("resid") feedstocks are suitable for the delayed coking process. Such petroleum residua are frequently obtained after removal of distillates from crude feedstocks under vacuum and such vacuum resids are characterized as being comprised of components of large molecular size and weight, generally containing: (a) asphaltenes and other high molecular weight aromatic structures that would, if used in other refining processes inhibit the rate of hydrotreating/hydrocracking and cause catalyst deactivation; (b) metal contaminants occurring naturally in the crude or resulting from prior treatment of the crude, which tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and NOx upon combustion of the petroleum residuum. Nitrogen compounds present in the resid also have a tendency to deactivate catalytic cracking catalysts.

Suitable feedstocks include, but are not limited to, residues from the atmospheric and vacuum distillation of petroleum crudes or the atmospheric or vacuum distillation of heavy oils, visbroken resids, tars from deasphalting units or combinations of these materials. Atmospheric and vacuum-topped heavy bitumens, coal liquids and shale oils can also be employed. Typically, such feedstocks are high-boiling hydrocarbonaceous materials having a nominal initial boiling point of about 510-550° C. (about 950-1020° F.) or higher, an API gravity of about 20° or less, and a Conradson Carbon Residue content of about 0 to 40 weight percent. The coker feedstock may be blended so that the total dispersed metals of the blend will be greater than about 250 wppm and the API gravity is less than about 5.2. A typical coker feedstock would be a vacuum resid which contains less than about 10 wt. % material boiling between about 480 and 560° C. (about 895° to 1040° F.) as determined by High Temperature Simulated Distillation.

In the delayed coking process as typically carried out, the feedstock is first heated to a temperature at which it can be pumped; the resid is normally heated before entering the combination tower of the delayed coking unit which operates both to fractionate the cracking products from the process as well as to pre-heat the feed to the coker furnace and combine recycle with the fresh incoming feed. The incoming feed picks up additional heat in the tower as it is mixed with the recycled bottoms fraction in the tower and is then fed to a heater, or coker furnace, at a pressure of about 350 to about 2400 kPag (about 50 to 350 psig), where the feedstock is heated to a temperature ranging from about 480

C. to about 525° C. (about 900 to 980° F.). The heated resid is then conducted to the coker drum. Pressures in the drum are maintained at a relatively low value in order to favor the release of the vaporous cracking products, typically below 550 kPag (about 80 psig) and preferably below 350 kPag (about 50 psig). Other details of typical process parameters may be taken from the Ellis tutorial, op. cit.

Coke Formation and Morphology

We hypothesize that the formation of asphaltene aggregates is a necessary condition for shot coke formation. Sponge coke asphaltenes do not possess the molecular structure to be adequately surface active even though they have a tendency to aggregate in the liquid resid to form stable asphaltene aggregates. Shot coke forming asphaltenes, on the other hand, exhibit enhanced aggregation because of the much higher solubility parameter of the aromatic-heteroaromatic 4-5 ring clusters contained in them. The higher their solubility parameter the more stable and oleophobic they become in their hydrocarbon matrix. This is especially emphasized after initial thermal treatment in the furnace where lower activation energy cleavage of alkyl and cycloalkyl moieties occur leaving behind the higher solubility parameter aromatic clusters.

The expression "sponge coke asphaltenes" is used here to refer to the asphaltenes in or from a residual heavy oil fraction which normally, in the absence of additives or other measures, form a sponge coke product in the delayed coking process. A "sponge coke resid" or "sponge coke forming resid", similarly, refers to a residual heavy oil fraction which normally, in the absence of additives or other measures, forms a sponge coke product in the delayed coking process. Conversely, "shot coke asphaltenes" is used here to refer to the asphaltenes in or from a residual heavy oil fraction which normally, in the absence of additives or other measures, form a shot coke product in the delayed coking process. A "shot coke resid" or "shot coke forming resid", similarly, refers to a residual heavy oil fraction which normally, in the absence of additives or other measures, forms a shot coke product in the delayed coking process.

We have found that even when resid contains relatively high levels of nickel and vanadium, the metals and their asphaltenes are not evenly distributed at the surfaces and in the bulk of the resid ; they agglomerate and are more preferably distributed in the bulk of the matrix. When asphaltenes of higher solubility parameter, namely those from a resid which tends to form a shot coke, are added to the sponge coke-forming resid, they form a polar coating on the sponge coke-forming asphaltene aggregates which enables the coated aggregates to aggregate more readily in the liquid hydrocarbon matrix. The coated aggregates, being more highly aggregated, provide a greater degree of access around which the shot coke nodules can be directed to form when exposed to the temperatures of the delayed coking process.

The initial objective of the present method, therefore, is to promote the aggregation of sponge coke asphaltenes in the resids as the resid is heated to coking temperatures and pressure and, by adding the asphaltenes from a shot coke-forming resid, to favor the formation of shot coke products when the resid with its aggregates passes through the delayed coking process. The formation of the aggregates with their subsequent dispersion through the hydrocarbon matrix is promoted by the addition of asphaltene derived from a petroleum resid which normally forms a shot coke product in the delayed coking process. The aggregates of the sponge coke asphaltenes are induced to form co-aggregates with the shot coke asphaltenes and these favor the production of the desired free-flowing shot coke product.

Proof of principle for the fundamental co-aggregation of shot coke asphaltene and sponge cake asphaltene has been provided by a tensiometer experiment.

Specifically, a film of asphaltene aggregate was formed at an oil-water interface and the interfacial elasticity at the oil-water interface measured. The interfacial elasticity modulus at the oil-water interface (E) was measured for representative shot coke asphaltene, sponge coke asphaltene and a mixture of 90/10 sponge coke/shot coke asphaltene. We observed shot coke asphaltene aggregates at the oil-water interface forming films with E=38 mN/m. The sponge coke asphaltenes are weakly surface active and form weak aggregate films with E=5 mN/m. When the sponge coke asphaltenes were mixed with shot coke asphaltenes the mixture exhibited an E of 28 mN/m, indicating co-aggregation at the interface and formation of mixed asphaltene aggregates even with the relatively smaller proportion of shot coke asphaltenes in the blend.

Shot Coke Asphaltenes

We have found that the molecular characteristic of the shot coke asphaltenes that renders them highly surface active and enables them to promote the formation of shot coke from a sponge coke forming resid is the presence of heteroatoms in the aromatic clusters attached to the main body of the asphaltene molecule. Generally, these clusters contain 4 or 5 aromatic rings linked to the ring system(s) making up the main body of the asphaltene molecule. Empirically, it appears that an average of at least one, heteroatom, e.g., 1 to 2, per 4 or 5 ring aromatic cluster will impart higher solubility parameter characteristics to the asphaltene with progressively higher levels of solubility (and effectiveness for promoting shot coke formation) achieved with higher average relative levels of heteroatoms, e.g., 1.5, per cluster, 2 or even more. Preferably, at least one of the heteroatoms is nitrogen.

Represented simply, the shot coke forming asphaltenes may be assigned the general formula:

$$R—A_c$$

where R is a hydrophobic moiety and $A_c$ is an aromatic moiety covalently bonded to R, typically a 4 or 5 ring aromatic cluster with at least one and typically 1 to 2 or 3, heteroatoms such as S, O or N, for each 4 or 5 rings. Typical of the aromatic moieties in such clusters are the preferred basic nitrogen-containing heterocyclic species, e.g., embedded pyridinyl, quinolinyl, acridinyl, phenanthridinyl, moieties as shown in the exemplary representative molecular structure in FIG. 1 where CORELINK signifies a continuation of the complex asphaltene molecular structure, with similar, but not necessarily identical, structure. Note that the average 5-ring aromatic cluster contains about 2 heteroatoms (N,S,O) per cluster imparting a higher solubility parameter to the structure. By contrast, the sponge coke forming asphaltenes contain about 0.5 heteroatoms (N,S,O) per average 5-ring aromatic cluster, imparting a lower solubility parameter to the structure. An exemplary representative molecular structure for a typical sponge coke forming asphaltene is shown in FIG. 2 where CORELINK is signified as above.

Figure 2:
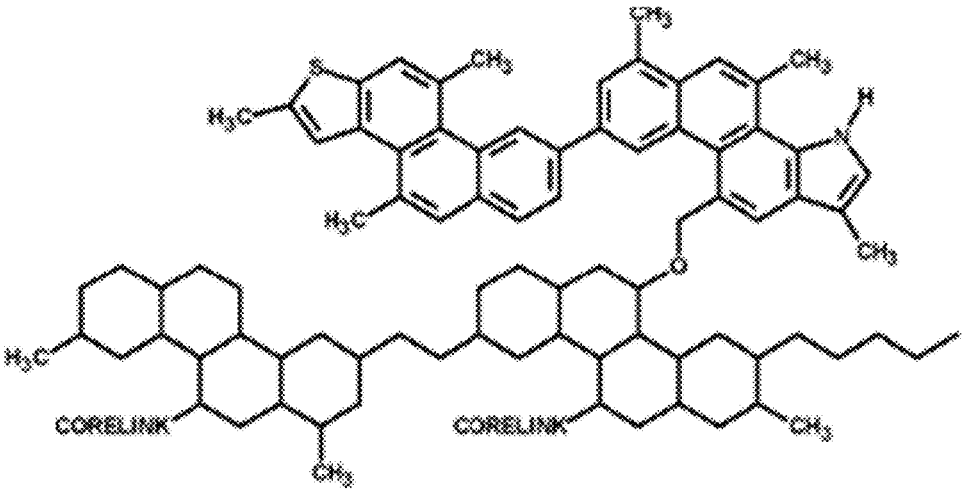
FIG. 2 is an exemplary representation of the structure of a sponge coke forming asphaltene.

The aromatic clusters referred to above may be linked to one another directly (as in the two 5-ring clusters linked directly to one another in FIG. 1) or by means of heteroatom bridges, e.g., oxygen, similar to the 4-ring structures shown in FIG. 2 although to confer the desired shot coke promoting effect, 1 or more heteroatoms will be present in each cluster.

Figure 3:
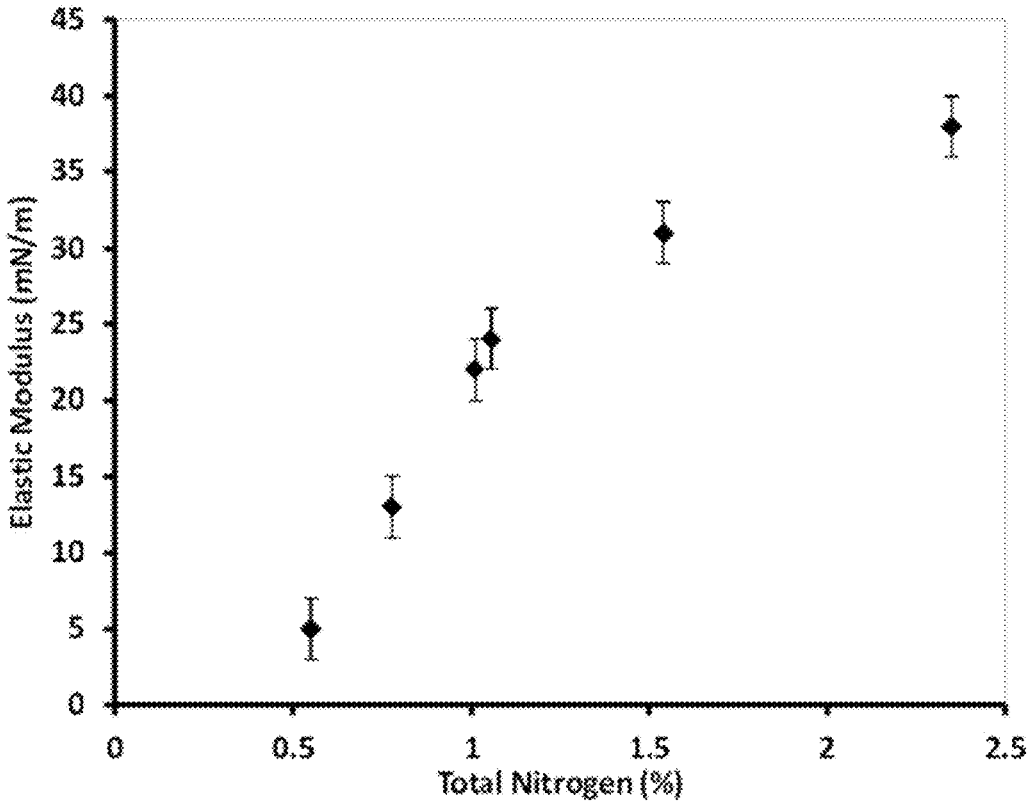
FIG. 3 is a graph illustrating the correlation of asphaltene interfacial elasticity with heteroatom content.

Using a suite of six shot coke and sponge coke forming asphaltenes we demonstrated empirically that the heteroatom content, preferably represented by nitrogen, of the asphaltene correlates with the interfacial elasticity as shown by FIG. 3.

There is a clear dependence between the heteroatom and, more specifically, the nitrogen content, of the asphaltenes and coke morphology: resids favoring the production of shot coke can be characterized as having a nitrogen content of at least 0.5 wt. percent, together with at least 250 ppmw of nickel plus vanadium.

If a given resid is a sponge coke former, the asphaltenes in the resid, when mobile at higher temperature, will self-associate and form aggregates: the asphaltenes are more polar (have a higher solubility parameter) than the hydrocarbon matrix in which they are dissolved but this factor does not favor dispersion in the non-polar hydrocarbon matrix; it does, however, promote association of the asphaltenes with their own kind. In addition, secondary bonding interactions are enhanced by the association of polars making the associated asphaltenes more stable. So, when shot coke asphaltenes which contain on average, at least 1, e.g., 2 or more, heteroatoms per 4-5 ring aromatic cluster, are added to a resid containing sponge coke asphaltene aggregates with an average ≤1 heteroatom per 4-5 ring aromatic cluster, they will associate with the sponge coke asphaltene balls. They can swell, but not disrupt the intramolecular interactions within the sponge coke clusters so they cover the outside of the clusters. The consequence of this is that the rest of the hydrocarbon matrix sees mainly the shot coke directing portion in the form of the shot coke directing aggregates.

The shot coke promoting asphaltenes may be derived from a resid, normally a vacuum resid derived by the distillation of a crude whose resids would produce shot coke. Suitable resids having the appropriate composition may be selected empirically using knowledge of experience with their coke-forming tendencies or by means of suitable analysis, e.g., by elemental, XPS, proton and carbon NMR, etc. to show the presence of the desired structures as set out above. The crude oil or vacuum resid can be treated by solvent deasphalting using one of the common light aliphatic solvents such as the $C_3$-$C_7$ paraffins, e.g., propane, butane, pentane, hexane, heptane, with propane being preferred for its greater selectivity although butane is also acceptable from the viewpoint of selectivity, i.e. in precipitating fewer of the resins. A preferred option for use with solvent deasphalting is the Kerr-McGee ROSE® Residual Oil Supercritical Extraction Process which recovers a significant proportion of the extraction solvent as a supercritical fluid and in so doing, reduces the thermal energy required for evaporative recovery.

In operation, the selected shot coke forming asphaltenes are mixed with the resid which would otherwise form sponge coke in the delayed coker. To form the mixture conveniently, the resid feed is first heated to a pumpable condition, suitably at a temperature of 100 to 150° C. which, in any event, is the normal pre-heat (prior to the furnace) condition in which the resid is fed into the combination tower. The shot coke forming asphaltene(s) is then mixed into the heated resid, preferably with the aid of a static mixer. The shot coke forming asphaltenes, being of a generally solid character are preferably taken up in an aromatic solvent to permit handling and mixing with the heated resid. A high boiling solvent should be selected so that it is not immediately evaporated under processing conditions although fast evaporation under the conditions, e.g., low pressure, higher temperature, in the coker drum will favor shot coke formation. A light cycle oil (FCC LCO) or clarified slurry oil (CSO) will typically be suitable. Although solvents of the requisite minimum boiling point, e.g., about 200° C. or higher, typically contain aromatics which promote dissolution of the asphaltenes and which will also tend to promote sponge coke formation. The amount of the solvent should therefore be controlled, relative to its aromaticity so that it does not negate the effect of the added polar asphaltenes by decreasing the oleophobic character of the aggregates and, consequently, the dispersion of the aggregates in the non-polar matrix. The solvents will not, however, normally be required in amounts which will interfere with the formation of the polar-coated aggregates. A suspension of water and the solvent is preferred since it has been found that the water distributes the asphaltenes better in the sponge coke forming resid and so achieves more uniform mixing. The relative proportion of aromatic solvent to water will typically be at least 1 percent v/v relative to the aromatic solvent; the maximum amount of water will typically be not more than 20percent v/v and preferably not more than 10 percent v/v relative to the aromatic solvent.

The proportion of the shot coke asphaltenes used in the process is quite low considering their effect on the coke product. Given that the shot coke asphaltenes are used to modify the sponge coke directing asphaltene aggregates, the amount of the shot coke asphaltenes added to the resid feed should be related to the asphaltene content of the resid. In general, as little as about 5 weight percent of the shot coke asphaltene relative to the asphaltene content of the sponge coke forming resid will tend to facilitate the formation of a free-flowing shot coke but typically at least 10 weight percent, e.g., about 15 weight percent. of the sponge coke forming resid; normally not more than 20 weight percent and preferably not more than 15 weight percent of the shot coke asphaltene(s) relative to the weight of the sponge coke directing asphaltenes will be appropriate. For example, therefore, with a resid feed that has 20 wt % sponge coke asphaltenes, 10% of this amount could normally be used as a baseline addition for the shot coke directing asphaltene so making the shot coke asphaltene addition equal to about 2 wt. % shot coke asphaltenes relative to the resid feed. An operating margin may be provided by using an excess, normally not more than 1:1 relative to the calculated baseline amount so that a 20 to 100 wt. % excess would lead to a total asphaltene addition equal to 2.4-4.0 wt. % to the resid feed. Intermediate levels over the baseline amount would lead to corresponding amounts of asphaltene being used, e.g., 40% excess would require the amount of added asphaltenes to be 2.8 wt. % of the resid, 60% excess to 3.2 wt. % of the resid, 80% to 3.6 wt. % of the resid.

The mixture of the shot coke asphaltene(s) and the sponge coke resid is then maintained at elevated temperature to allow the aggregates of the shot coke asphaltenes to form around the sponge coke asphaltenes; ideally this will be a relatively fast process, taking place in the space of a few minutes although in some cases with refractory feeds with a strongly sponge coke forming tendency, longer residence times may be required. In most case, the formation of the shot coke-surfaced aggregates will take place in a transfer line, for example, in the line feeding the combination tower or the line from the combination tower to the furnace with further modification potentially occurring in the transfer line from the furnace to the coking drum. If it be found that longer residence times are required or desirable, e.g., one hour, or longer, the mixture may be held in heated storage tanks for the necessary duration.

Once the coking phase of the delayed coking cycle with the modified feed has been completed, the free-flowing shot coke which forms under the influence of the added asphaltene(s) may be discharged from the coking drum in the manner described in the earlier patent application noted above with a consequent reduction in the cycle time and an increase in unit throughput.

The delayed coking process to form shot coke and thermally cracked coker products from a sponge coke- and/or transition coke-forming resid may therefore be summarized, in its typical and preferred form, as follows:

(i) heating the resid to a pumpable temperature, (ii) adding a shot coke asphaltene, preferably in the form of a solution in a solvent and more preferably, a mixture of water and solvent, to the sponge coke forming resid, (iii) mixing the solution of the shot coke asphaltene in the heated resid to form shot coke directing asphaltene aggregates in the resid, (iv) maintaining the resid/added asphaltene mixture at an elevated temperature, e.g., in the range of 100 to 150° C., to form co-aggregates of sponge coke and shot coke asphaltenes, and (v) heating the heated resid of step (iv) to a delayed coking temperature, e.g., in the range of 380 to 525° C., to form a free-flowing shot coke product and thermally cracked coker products.

The shot coke asphaltene(s) may be used in combination with other methods of promoting the formation of a free-flowing shot coke, for example, the techniques described in the patents and applications from ExxonMobil Research and Engineering Company describing the production of a free-flowing shot coke during the delayed coking process, as noted above in the introduction, for instance, the addition of metallic or non-metallic additives with or without added caustic or oxidizing agent, such as vanadate or naphthenate salts of sodium or potassium, rice hulls, ground rubber tires, low molecular weight aromatic compounds (see WO 2005/113711), polymeric additives (see WO 2005/113712), over-based detergents (see WO 2005/113710), etc, etc. Other factors favoring the production of shot coke have also been noted by Siskin et al, *Energy & Fuels,* 2006, 20, 1227-1234, including high concarbon:asphaltene ratio, more rapid pyrolysis rate, absence of aromatic solvents such as clarified slurry oil (CSO) and a high foam layer. Resort may be made to these expedients in the present case also to facilitate the production of the free-flowing shot coke. In favorable cases, continuous operation of the delayed coker may also become possible as described in U.S. Pat. No. 7,914,668.

As noted above, aromatics tend to decrease the oleophobicity of the co-aggregates; for this reason, the amount of solvents such as CSO, FCC cycle oil should be controlled consistent with the objective of promoting shot coke formation.

For similar reasons, recycle from the combination tower which comprises largely high boiling aromatic cores from which aliphatic side chains have been removed in the cracking process, should be minimized although a balance will need to be sought with the coker bottoms production. Typically, up to about 10 wt. % recycle can be tolerated although less may be appropriate if the resid feed is one which has a tendency to produce sponge coke or even a transition coke product. The amount of recycle can therefore be selected on an empirical basis according to experience with the resid being used.

The invention claimed is:

1. A delayed coking process to form shot coke and thermally cracked coker products from a sponge coke- and/or transition coke-forming resid which comprises:

mixing asphaltene derived from a shot coke-forming petroleum residual feed in the form of a solution in a mixture of an aromatic solvent and water with a heated sponge coke-and/or transition coke-forming resid feed to form shot coke asphaltene aggregates in the sponge coke and/or transition coke forming resid, holding the mixture of sponge coke- and/or transition coke-forming resid and the shot coke asphaltene aggregates at an elevated temperature in the range of 100 to 150° C. to allow co-aggregates of sponge coke and shot coke asphaltenes to form, heating the heated sponge coke- and/or transition coke-forming resid containing the co-aggregates of sponge coke and shot coke asphaltenes to a delayed coking temperature to form shot coke and thermally cracked coker products;

wherein the relative proportion of aromatic solvent to water in solution with the asphaltene derived from the shot coke-forming petroleum residual feed is at least 1 percent v/v relative to the aromatic solvent and not more than 20 percent v/v-; and wherein the proportion of the asphaltene derived from a shot coke-forming petroleum residual feed in the mixture of sponge- coke and/or transition coke-forming resid and the shot coke asphaltene aggregates is at least 5 weight percent of the sponge coke- and/or transition coke-forming resid and not more than 20 weight percent.

2. A delayed coking process according to claim 1 in which the asphaltene derived from the shot coke-forming petroleum residual feed comprises an asphaltene with aromatic clusters containing an average at least 1 heteroatom per cluster.

3. A delayed coking process according to claim 2 in which the asphaltene derived from the shot coke-forming petroleum residual feed comprises an asphaltene with aromatic clusters containing 4 or 5 aromatic rings with at least 1 heteroatom per cluster.

4. A delayed coking process according to claim 3 in which the asphaltene derived from the shot coke-forming petroleum residual feed comprises an asphaltene with aromatic clusters containing 4 or 5 aromatic rings with an average of 1 to 2 heteroatoms per cluster.

5. A delayed coking process according to claim 2 in which the asphaltene derived from the shot coke-forming petroleum residual feed comprises an asphaltene with aromatic clusters containing 4 or 5 aromatic rings with an average of 1 to 2 heteroatoms per cluster, at least one of which is nitrogen.

6. A delayed coking process according to claim 2 in which the asphaltene derived from the shot coke-forming petroleum residual feed comprises an asphaltene with a nitrogen content of at least 0.5 wt. percent.

7. A delayed coking process according to claim 6 in which the asphaltene derived from the shot coke-forming petroleum residual feed comprises an asphaltene with a nitrogen content of at least 0.5 wt. percent, and at least 250 ppmw of nickel plus vanadium.

8. A delayed coking process according to claim 7 in which the asphaltene derived from the shot coke-forming petroleum residual feed comprises an asphaltene with a nitrogen content of at least 0.5 wt. percent, at least 250 ppmw of nickel plus vanadium and not more than 10.5 wt. percent hydrogen.

9. A delayed coking process to form shot coke and thermally cracked coker products from a feed comprising a sponge coke- and/or transition coke-forming petroleum vacuum resid which comprises:

heating the sponge coke- and/or transition coke-forming petroleum vacuum resid to a pumpable temperature, (ii) mixing the heated sponge coke- and/or transition coke-forming petroleum vacuum resid with asphaltene derived from shot coke-forming petroleum vacuum resid in the form of a solution in a mixture of an aromatic solvent and water, (iii) forming aggregates of the asphaltene derived from the shot coke forming petroleum vacuum resid with aggregates of asphaltenes of the sponge coke- and/or transition coke forming petroleum vacuum resid, (iv) heating the mixture of heated sponge coke- and/or transition coke-forming petroleum vacuum resid and asphaltene derived from the shot coke forming petroleum vacuum resid of step (iii) to a delayed coking temperature, to form a free-flowing shot coke product and thermally cracked coker products;

wherein the relative proportion of aromatic solvent to water is at least 1 percent v/v and not more than 20 percent v/v relative to the aromatic solvent; and wherein the proportion of the asphaltene derived from a shot coke-forming petroleum residual feed in the mixture of heated sponge coke- and/or transition coke forming petroleum vacuum resid and asphaltene derived from the shot coke forming petroleum vacuum resid of step (iii) is at least 5 weight percent of the sponge coke- and/or transition coke forming petroleum vacuum resid and not more than 20 weight percent.

10. A delayed coking process according to claim 9 in which the asphaltene derived from the shot coke-forming petroleum vacuum resid comprises an asphaltene with aromatic clusters containing 4 or 5 aromatic rings with an average of 1 to 2 heteroatoms per cluster.

11. A delayed coking process according to claim 10 in which the asphaltene derived from the shot coke-forming petroleum vacuum resid comprises an asphaltene with aromatic clusters containing 4 or 5 aromatic rings with an average of 1 to 2 heteroatoms per cluster, at least one of which is nitrogen.

12. A delayed coking process according to claim 10 in which the asphaltene derived from the shot coke-forming petroleum vacuum resid comprises an asphaltene with a nitrogen content of at least 0.5 wt. percent.

13. A delayed coking process according to claim 12 in which the asphaltene derived from the shot coke-forming petroleum vacuum resid comprises an asphaltene with a nitrogen content of at least 0.5 wt. percent, at least 250 ppmw of nickel plus vanadium and not more than 10.5 wt. percent hydrogen.

14. A delayed coking process according to claim 9 in which the asphaltene derived from shot coke-forming petroleum vacuum resid has the general formula:

R—Ac where R is a hydrophobic moiety and Ac is a 4 or 5 ring aromatic cluster covalently bonded to R with an average of at least one heteroatom for each 4 or 5 ring cluster.

15. A delayed coking process according to claim 14 in which the asphaltene derived from the shot coke-forming petroleum vacuum resid has an average of 1 to 2 nitrogen atoms for each 4 or 5 ring cluster.

16. A delayed coking process according to claim 15 in which the asphaltene derived from the shot coke-forming petroleum vacuum resid has an average of 1 to 2 basic N containing aromatic heterocyclic moieties, for each 4 or 5 ring aromatic cluster.

17. A delayed coking process according to claim 9 in which the mixture of the heated sponge coke- and/or transition coke-forming petroleum vacuum resid with the asphaltene derived from shot coke-forming petroleum vacuum resid is passed from a coker combination tower to a coker furnace wherein the aggregates of the asphaltene derived from the shot coke-forming petroleum vacuum resid and the aggregates of asphaltenes of the sponge coke- and/or transition coke forming petroleum vacuum resid are formed during passage from the coker combination tower to the coker furnace.

* * * * *